US005140801A

United States Patent [19]

Wild

[11] Patent Number: 5,140,801

[45] Date of Patent: Aug. 25, 1992

[54] APPARATUS FOR FILLING FOLDED SHEET BAGS

[75] Inventor: Rainer Wild, Heidelberg, Fed. Rep. of Germany

[73] Assignee: Indag Gesellschaft Fur Industriebedarf mbH, Eppelheim/Heidelberg, Fed. Rep. of Germany

[21] Appl. No.: 578,813

[22] Filed: Sep. 5, 1990

[30] Foreign Application Priority Data

Sep. 14, 1989 [DE] Fed. Rep. of Germany ..... 3930829

[51] Int. Cl.[5] ..... B65B 43/30; B65B 51/14

[52] U.S. Cl. ..... 53/459; 53/468; 53/479; 53/374.2; 53/374.8; 53/386.1; 141/157

[58] Field of Search ..... 53/386, 570, 571, 573, 53/459, 468, 469, 479, 374.2, 374.8, 386.1; 200/61.19, 61.42; 141/157, 314, 315, 316, 94, 385, 114

[56] References Cited

U.S. PATENT DOCUMENTS

| | | | |
|---|---|---|---|
| 3,398,503 | 8/1968 | Bertoglio | 53/386.1 X |
| 3,715,858 | 2/1973 | Durant et al. | 53/386.1 X |
| 3,830,266 | 8/1974 | Hudson | 141/114 X |
| 3,943,687 | 3/1976 | Cerioni | 53/571 |
| 4,182,094 | 10/1980 | Lieder et al. | |
| 4,334,558 | 6/1982 | Durant | 141/114 |
| 4,363,203 | 12/1982 | Marshall et al. | |
| 4,532,967 | 8/1985 | Graf | |
| 4,712,360 | 12/1987 | Bertoglio | 53/386.1 X |
| 4,877,160 | 10/1989 | Derving | |

FOREIGN PATENT DOCUMENTS

| | | |
|---|---|---|
| 2909940 | 9/1979 | Fed. Rep. of Germany |
| 3031306 | 3/1981 | Fed. Rep. of Germany |
| 3210668 | 10/1982 | Fed. Rep. of Germany |
| 3116458 | 11/1982 | Fed. Rep. of Germany |
| 3225692 | 1/1984 | Fed. Rep. of Germany |
| 3319901 | 12/1984 | Fed. Rep. of Germany |
| 3441947 | 5/1986 | Fed. Rep. of Germany |
| 3622868 | 1/1988 | Fed. Rep. of Germany |

*Primary Examiner*—Horace M. Culver
*Attorney, Agent, or Firm*—Darby & Darby

[57] ABSTRACT

Two vacuum-type suction bells are movable towards and away from a bag for opening the bag. When open, a feed pipe is inserted into the bag for filling the bag with fluid. Sealing elements move toward the bag for sealing the same about the feed pipe. The sealing elements have a recess into which is received the suction bells as the sealing elements abut the feed pipe. The suction bells may move relative to the sealing elements.

15 Claims, 4 Drawing Sheets

APPARATUS FOR FILLING FOLDED SHEET BAGS

DESCRIPTION

The present invention refers to an apparatus for filling folded sheet bags and especially to an apparatus for filling folded sheet bags provided with a filling spout.

An apparatus which is, however, not provided for handling sheet bags including a filling spout, has become known from German-Offenlegungsschrift 34 41 947. This known apparatus serves to open the sheet bag prior to the filling operation and it is provided with a pair of tongs holding the bag at its two side seams. Parallel to the upper edge of the bag two jaws are provided, which are adapted to be moved towards each other and which comprise a rigid strip and a thick, yielding coating of soft rubber secured to said strip. Each jaw is equipped with a pipe connection by means of which it can be connected to a vacuum pump. The jaws have an opening, which extends through the strip and through the coating and which is connected to the pipe connection and defines a suction opening. For the purpose of opening the bag, the jaws are first moved towards each other and the bag is clamped in position by said jaws. Subsequently, the sides of the bag are held on the jaws by means of a vacuum and the jaws move apart, whereby the bag is opened. A gas injection nozzle is introduced in the bag, whereupon the jaws close again and seal the bag. The bag is caused to bulge by a gas blast and in a subsequent filling operation it is filled with a liquid and closed.

In numerous cases of use, e.g. when packing liquid detergents or washing-up liquids (so-called refill packages), but also for the purpose of packing drinks, the use of sheet bags provided with a filling spout proved to be advantageous. However, when such bags are to be filled, substantial difficulties arise, since the force required for opening the bag is comparatively high and since, consequently, numerous bags pass through the system without being opened in cases in which a conventional system is used. Furthermore, problems also arise with regard to the sealing of the bag.

Hence, the present invention is based on the task of providing an apparatus of the type mentioned at the beginning, which permits a reliable opening and filling operation for opening and filling folded sheet bags and in the case of which reliable sealing of the bag with respect to the surrounding area is achieved during the filling operation.

The apparatus according to the invention uses for the purpose of opening and filling sheet bags a principle which is absolutely new in comparison with the prior art. Whereas the cited prior art uses soft-rubber sealing strips, which have provided therein holes acted upon by a vacuum, the present invention uses two separately movable suction means in the case of which it is possible to achieve high suction forces with comparatively low contact forces.

It turned out that a big problem arising in connection with the bag opening operation resides in the fact that a specific contact force is necessary between the suction means and the bag surface so as to achieve a sealing effect which permits a sufficient vacuum to build up between the suction means and the bag, the bag being held in position by said vacuum. If the contact force required for generating the vacuum is too high, it will be more difficult to open the bag and to let air flow into the filler opening. If, however, the flow of air into the bag is made much more difficult or prevented, the forces required for drawing the sheet sections apart will increase strongly so that it will be very difficult to open the bag in a reliable manner.

In view of the fact that the separately movable suction means are not simultaneously used as sealing means of the feed pipe, the possibilities of constructing said suction means are by far less limited than in the case of the prior art, and, consequently, said suction means can apply the force in concentrated form to the respective area of the bag.

In view of the fact that the opening means are constructed as suction bells, it is achieved that a high vacuum can be obtained between the suction bell and the sheet of the bag even in the case of a low contact force. The force required for opening the bag against the ambient pressure is thus comparatively small, since the air can flow into the filler opening during the filling operation without excessive hindrance.

Just as in the case of the prior art, a feed pipe is introduced into the filling spout when the bag has been opened, said feed pipe being then sealed by the sealing means. In view of the fact that, in accordance with the present invention, the bag opening function and the function of sealing the bag with respect to the feed pipe are fulfilled by separate components, the sealing means can be provided with an improved structural design so that an absolutely reliable sealing effect is achieved between the feed pipe and the bag. A feature which proves to be particularly advantageous with regard to the operation of the apparatus is the feature that the sealing means are, in turn, provided with recesses receiving therein the opening means. Hence, it is not necessary to remove the opening means form the bag, when the sealing means have been moved to this position. This will not only facilitate handling of the bag within the apparatus, but is will also essentially speed up the filling operation, since the period of time elapsing between the opening of the bag and the closing of the sealing means can thus be reduced to a minimum.

Furthermore, due to the high sealing effect which can be achieved by the separate sealing means, the sheet bag can be filled directly without being previously caused to bulge by a gas blast. In cases in which the bag is caused to bulge by means of a gas blast, the requirements which have to be fulfilled by the sealing effect between the feed pipe and the bag are comparatively simple, since an escape of gas, which can be air or nitrogen, for example, will normally not interfere with the operational reliability of the system. A certain loss of the amount of air or nitrogen supplied will not have any effect on the surrounding area. In cases in which liquids, e.g. detergents or the like, are filled in, the requirements which are to be fulfilled by the sealing means are much higher, and these requirements can be fulfilled in a reliable manner by the structural design according to the present invention.

In accordance with a preferred embodiment of the invention, the suction bells are constructed as spherically formed rubber elements, e.g. as ball sections. The work rubber element means in this case that, in addition to natural gum, it is, of course, also possible to use other elastic materials in a corresponding manner for the production of these suction bells. The advantage of suction bells of this type is that, when the vacuum is generated within the suction bell, a high sealing effect is achieved, the contact force being, however, only small. This has the effect that air can flow in even more easily when the sheet bag is being opened.

The rubber elements are preferably held by suction heads, which are preferably secured to a displaceably supported pipe by means of which the suction heads can be moved towards and away from the sheet bag. Said pipe is preferably also used for connecting the suction bells and the suction head to a vacuum source.

The pipe, which has secured thereto the suction heads, is preferably guided through an opening in the sealing means. The sealing means and the suction means can thus be moved relative to one another in a simple manner.

In accordance with an additional preferred embodiment of the present invention, the sealing means are provided with a sealing edge arranged above the suction means. This sealing edge produces a sealing effect with respect to the feed pipe, and, in the case of the present structural design, it can be constructed without regard tot he arrangement of the suction bells.

The sealing means and, consequently, also the sealing edge are preferably made of metal, e.g. aluminum or brass. If necessary, this metal has applied thereto only a thin sealing cover of elastic material. The use of the sealing edge on the one hand and the use of an only thin elastic layer on the other hand provide the possibility of realizing, in a small area, a comparatively high contact force of the sealing means. A high sealing pressure is thus produced, and this sealing pressure has the effect that the sheet is in full contact with the feed pipe. A reliable sealing effect is thus produced around the entire circumference of the feed pipe, i.e. also at the separating plane between the two sealing means.

In accordance with a preferred embodiment of the present invention, the apparatus is provided with a sensor means indicating whether a sheet bag has correctly been received in the apparatus.

This sensor means can, for example, be constructed as a pressure sensor, which measures the pressure in the feed pipe of the suction bells and which determines whether the vacuum was sufficiently high for pulling the bags apart. If the apparatus does not have inserted therein any bag, the next filling operation will not be started until a new bag has been supplied in a correct manner.

The above also applies to cases in which the bag tears during the suction process or while it is being pulled apart.

In accordance with another preferred alternative, a contact spring is provided on each sealing means, said contact spring consisting of metal and abutting on the feed pipe—which, in this case, is made of metal as well—when the apparatus does not have inserted therein any bag. By means of the contact between the contact spring and the metallic feed pipe an electric circuit is closed, and the malfunction of the system is compensated for. If a sheet bag has been inserted in the apparatus, the plastic sheet will act as an insulation between the contact spring and the metallic feed pipe so that the electric circuit will not be closed and no alarm will be given.

Additional advantages, features and possibilities of use of the present invention result from the subclaims and from the description of an embodiment following hereinbelow in connection with the drawing, in which FIG. 1 shows a perspective representation of a filling station according to the present invention;

Figure 1:
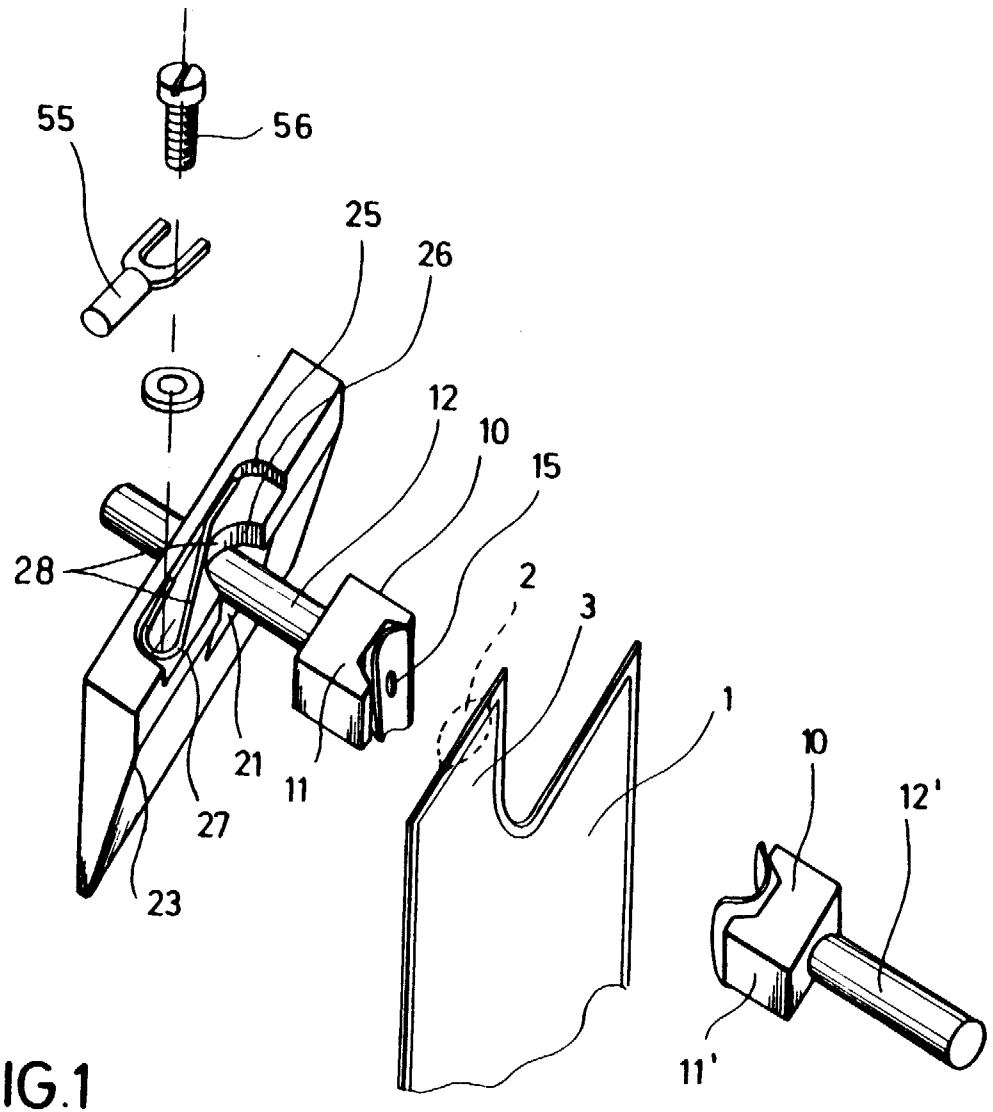
FIG. 1 shows a perspective view of a filling apparatus according to one embodiment of the present invention, said figure showing essentially only one half of the filling apparatus for reasons of a clearer graphic representation.
Figure 2:
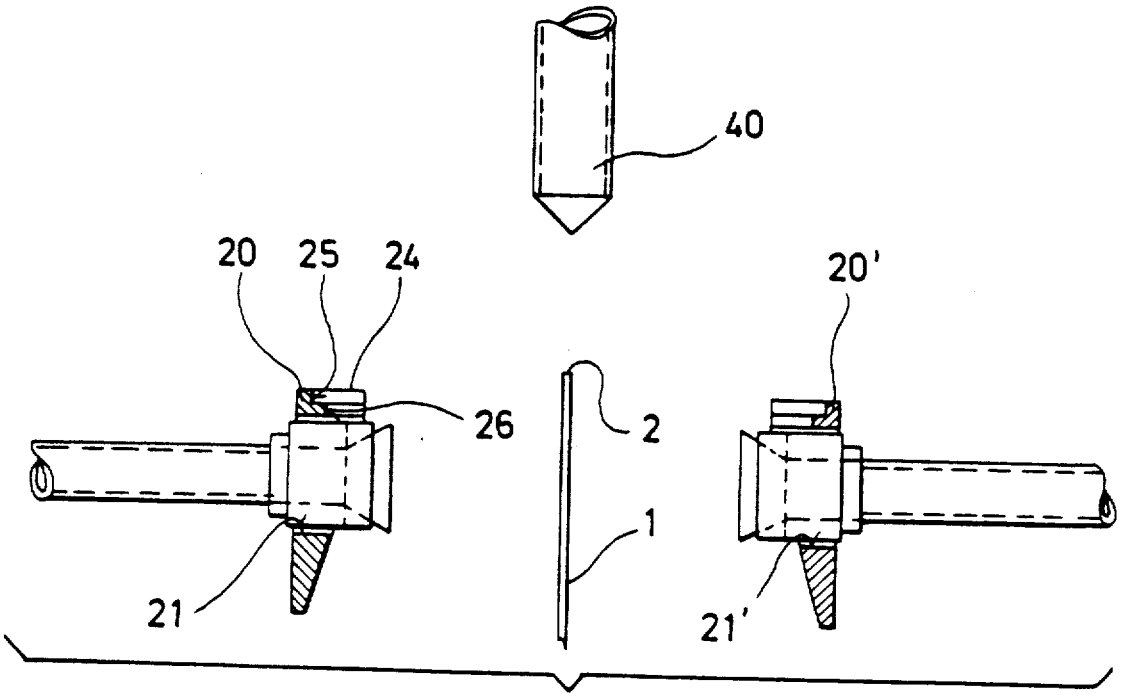
FIG. 2 shows a schematic side view of the filling apparatus according to FIG. 1, said schematic side view being partially cut.

The filling apparatus shown serves to fill a sheet bag 1, which is schematically shown in the drawing, said sheet bag being provided with a filling spout 2. The filling spout 2 is provided on a filling section 3 of the bag, which is set off with regard to the rest of the bag surface.

The bag is introduced in the apparatus in a folded condition, i.e. in a condition in which the filling spout is closed, and in said apparatus it is held at its lateral edges, e.g. by pairs of tongs (not shown).

The devices used for transporting the sheet bag to the filling device and for transporting the bag then away are known in prior art and, consequently, they need not be explained in the present application.

Figure 6:
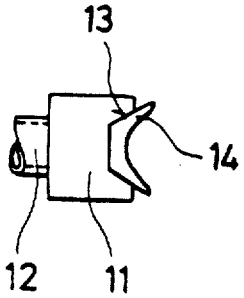
FIG. 6 shows a cut top view of a suction head of the embodiment according to FIG. 1 to 5.

The device for filling the sheet bag is provided with an opening means 10, which consists of two suction heads, viz. a suction head 11 on the left-hand side (in FIG. 1) and a suction head 11 ' on the right-hand side. The suction heads are connected to a pipe 12 and 12', respectively, and are held by said pipe. The pipes 12, 12' are connected to a vacuum source (not shown). The suction heads 11, 11' (cf. also FIG. 6) has a cut-out section 13 at their front side, which faces the sheet bag, said cut-out section being arranged parallel to the axis of the filling spout of the bag and having an essentially trapezoidal cross-section, the longer lateral edge of the trapezoid being located at the suction head end positioned adjacent the bag. This cut-out section has arranged therein a suction bell 14, which consists of an elastic material, such as rubber, soft plastic or the like. As long as it is not deformed, the suction bell 14 has essentially the shape of a ball section, but, as is clearly shown by FIG. 6, said suction bell is adapted to the shape of the trapezoidal cut-out section 13 of the suction head by elastic deformation.

The suction bell 14 is provided with a central opening 15, which communicates with the pipe 12 through a hole (not shown) provided in the suction head.

The sealing strips 10, 20', which, just as the suction heads 11, 11', consist of metal, e.g. aluminum or brass, are located on both sides of the sheet bag 1. In their upper area, the sealing strips have an essentially rectangular cross-section 24, which is downwards, i.e. in the direction of movement of the feed pipe which will be explained hereinbelow, followed by a triangular cross-section 23. A recess 21 is located below the rectangular cross-section 24, said recess 21 being adapted to receive therein the suction heads 11, 11'.

The rectangular cross-sectional area of the sealing strips is provided with two recesses, viz. a first, upper and longer recess 25 as well as a lower semicylindrical recess 26.

The last-mentioned semicylindrical recess 26 has a radius which is slightly larger than the radius of the feed pipe 40. The sealing edge, which serves to seal the feed pipe during the filling operation, is defined by the semicylindrical recess 26 and by the edge 27, which extends at both sides of the semicylindrical recess 26 and which is defined by the recess 25 and by the rectangular cross-sectional area 24. This sealing edge, which is, as a whole, provided with reference numeral 28 and which consists of the edge 27 extending at both sides of the semicylindrical recess 26 and of the peripheral surface of the semicylindrical recess 26, produces the sealing effect between the sealing strips and the feed pipe 40. In order to improve the sealing effect, the sealing edge 28 can be provided with a thin elastic cover (not shown in the drawing) whose function will be explained hereinbelow.

A feed pipe or filling pipe 40 serves to fill the bag, said feed pipe being arranged centrally between the displaceable sealing strips and being positioned such that, for the purpose of filling, it is displaced downwards and inserted into the filling spout 2 of the sheet bag 1. At its opening facing the bag, the feed pipe is provided with a conical extension 41 so as to facilitate insertion into the filling spout. This conical extension 41 is adapted to be moved relative to the filling pipe via a pin 42—a feature which is fundamentally known in the prior art. The cone 41 and the feed pipe 40 thus form a kind of valve by means of which the filling operation can be controlled.

Figure 4:
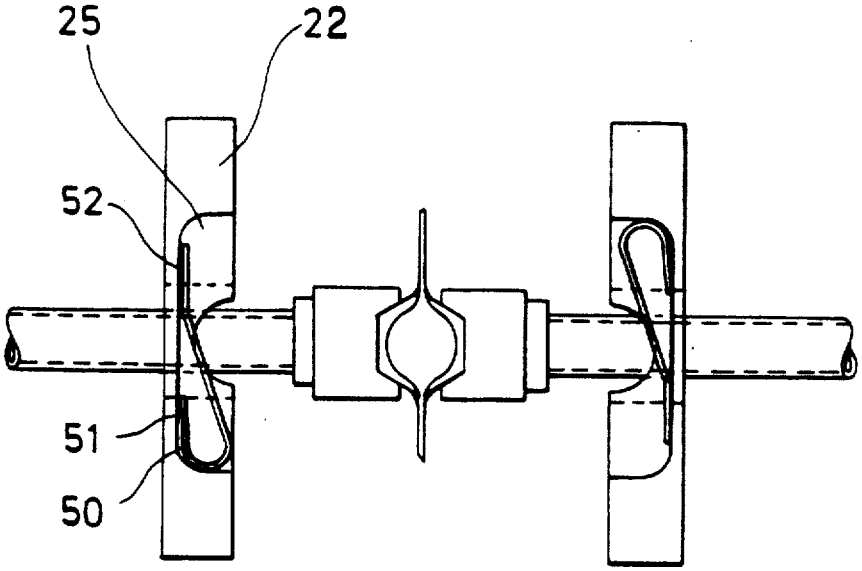
FIG. 4 shows a top view of the representation according to FIG. 3.

As can especially be seen in FIG. 1 and 4, the sealing strips have provided therein a contact spring 50, which is located in the area of the upper recess 25 and which is bent such that it is essentially hookshaped, the short end 51 of the hook being located at the side of the recess 25 facing away from the sheet bag and the other end of the hook being arranged such that it projects beyond the semicylindrical recess 26, whereas on the other side of said semicylindrical recess a straight portion 52 of said other hook end extends towards the side of the sealing strip 22 facing away from the sheet bag. As can be seen in FIG. 1, the contact spring is connected to a control means (which is not shown) via a cable lug 55 and a fastening screw 56 and via a cable (which is not shown either).

The function of the filling apparatus will now be described while making reference to FIG. 2 to 5 and 7.

Figure 3:
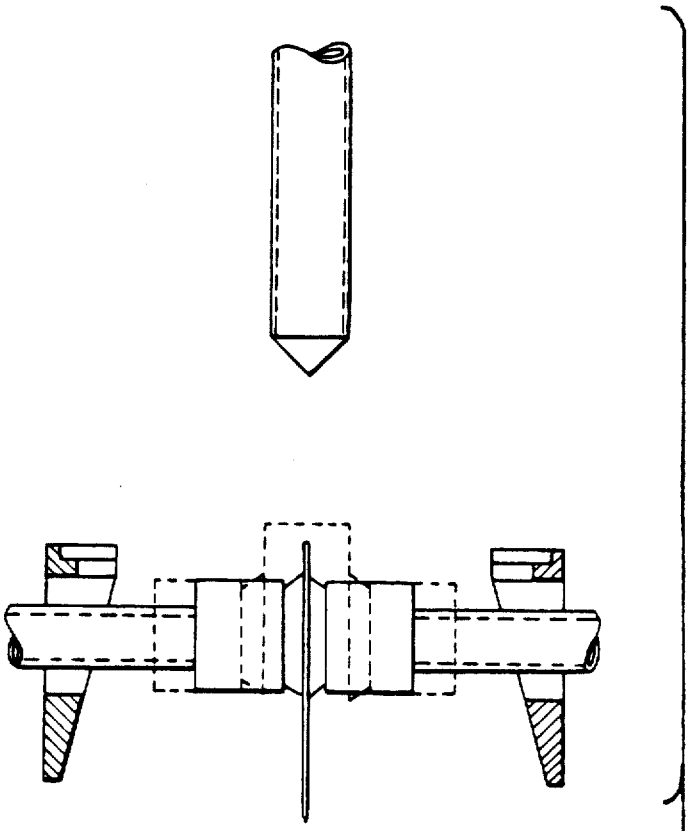
FIG. 3 shows the filling apparatus in a representation according to FIG. 2 during the opening process.

As can be seen in FIG. 3, the closed sheet bag with its closed filling spout 2 is positioned between the sealing strips 21 and the suction heads 11 as well as below the feed pipe 40 at the beginning of the filling operation. The sheet bag is held in this position e.g. by a pair of tongs. The filling operation is started by moving the suction heads 11, 11' towards the sheet bag 1, as can be seen in FIG. 3. The sealing strips 20, 20' do not change their position in the course of this process. As soon as the suction heads are in connection with the sheet bag, the suction bells 14, which consist of an elastic material, cling to the sheet bag. A vacuum is then produced between the suction bells 14 and the sheet bag and the suction heads are caused to move slightly apart. Experiments have shown that, when said suction heads are moved slightly apart, the filling spout of the sheet bag virtually bursts open. In view of the fact that the contact force of the suction bells, which rest on the sheet bag with their circumferentially extending edges, is comparatively small, the introduction of air into the filling spout is not impeded, said air being absolutely necessary for detaching the two sheet sides of the filling spout from each other.

Figure 7:
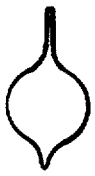
FIG. 7 shows a top view of the open filling spout.

FIG. 4 shows a top view of the suction heads, the filling spout of the sheet bag being positioned between said suction heads. FIG. 7 shows the cross-section of the filling spout itself. Due to the forces acting on said filling spout, the cross-section is not precisely circular, but it can be described as consisting rather of two semi-ellipses, the sheet approaching asymptotically the central plane of the sheet bag at the lateral edges of said cross-section.

Figure 5:
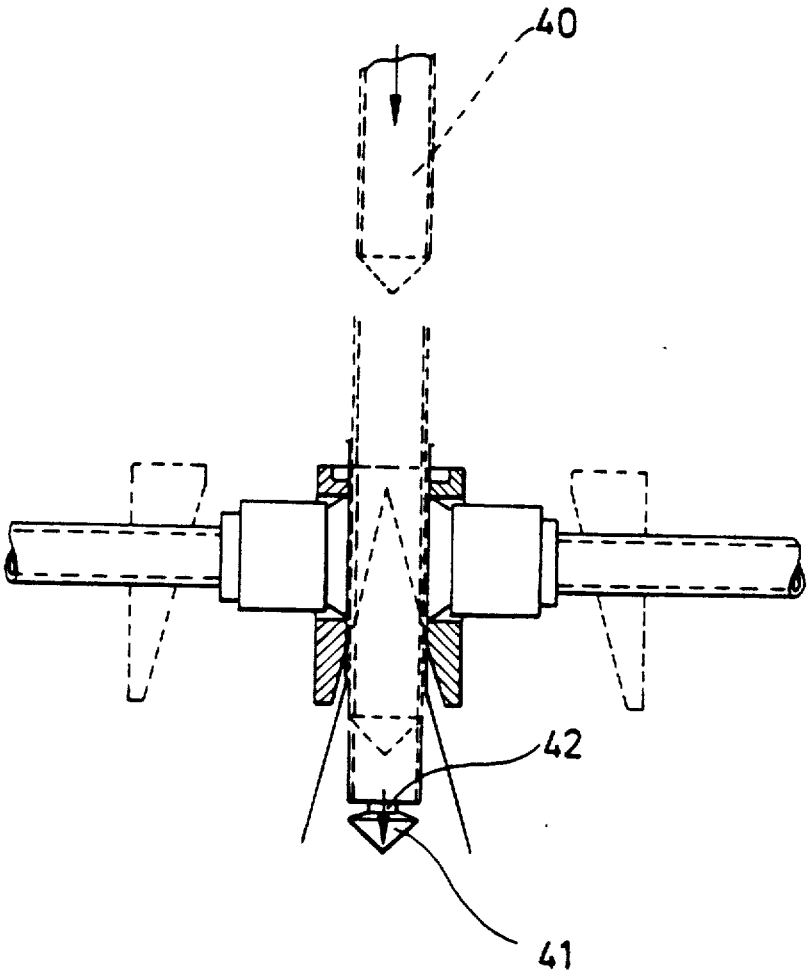
FIG. 5 shows the filling apparatus in a condition in which the feed pipe has already been inserted and sealed.

As can be seen in FIG. 5, the feed pipe 40 is inserted into the filling spout when the bag has been opened. Insertion into the filling spout is facilitated by the special structural design of the suction heads whose trapezoidal recess 13 is adapted to the cylindrical circumference of the feed pipe 40.

As soon as the feed pipe has been inserted into the filling spout, as can be seen in FIG. 5, the sealing strips move towards each other and press the sheet bag against the feed pipe. In order to achieve complete sealing, a comparatively high contact pressure is required so as to obtain perfect sealing of the sheet in the area where the spout halves asymptotically approach the central plane of the sheet. In other words, the filling spout, which tends to assume an approximately elliptical cross-section, must be caused to assume a cross-section having precisely the shape of a circular cylinder, since, otherwise, complete sealing is not possible. In order to achieve this, the sealing edge 28 is provided, which, due to its small surface, applies a high contact pressure to the sheet although the contact force is comparatively weak and which, consequently, produces an absolutely reliable sealing effect between the feed pipe and the sheet. The sealing effect can additionally be increased by a thin elastic cover consisting e.g. of plastic material. Reference must, however, be made to the fact that the sealing forces which are to be applied are comparatively high so that the use of e.g. a thick cover of soft rubber is not possible in this case.

When the sealing operation has been finished, the filling process is started in the course of which the liquid to be filled in is supplied through the filler pipe. The sheet bag will then bulge automatically due to the liquid which is filled in. In view of the fact that, due to the triangular cross-section 23, the sealing strips extend away from the sheet bag in their lower area, bulging of the bag will not be impeded by said sealing strips.

Reference must, however, be made to the fact that it is also possible to supply first only gas through the feed pipe and to carry the filling operation then out as an additional process step.

When the sealing strips have been closed, the contact springs 50 abut on the metallic feed pipe 40. An electric contact between the contact springs and the feed pipe is, however, prevented by the intermediately disposed sheet of the sheet bag. If, however, the apparatus does not have inserted therein any sheet bag due to malfunction or if the sheet bag tore during the opening operation, a direct electric contact will be established between the contact spring 50 and the feed pipe 40. This will have the effect that an electric circuit is closed, which makes known to the control means that the apparatus does not have inserted therein any sheet bag. The filling operation is therefore interrupted, a possible existing damaged sheet bag is ejected, and a new sheet bag is supplied.

An alternative or an additional examination of the function of the apparatus can be carried out by measuring the pressure in the feed pipes 12, 12' of the suction heads. If the apparatus does not have inserted therein any sheet bag or if the sheet bag tore during the opening operation, the pressure within the feed pipes will deviate from the normally existing vacuum and the control means will thus again be able to detect the malfunction.

I claim:

1. An apparatus for opening and filling a folded sheet bag, comprising two vacuum-type opening means for opening the bag, each of the opening means being adapted to be moved towards and away from the bag, a feed pipe for filling the bag with a fluid, the feed pipe being adapted to be inserted into the bag, and two sealing means for sealing the bag with respect to the inserted feed pipe as said two sealing means abut on the feed pipe, the opening means having suction bells which are adapted to be moved relative to the sealing means for effecting the opening of the bag in response to gripping the bag under vacuum with the suction bells while moving the suction bells away from each other, the sealing means being provided with a recess for receiving therein the opening means as said sealing means abut on the feed pipe.

2. An apparatus according to claim 1, wherein the suction bells are constructed as spherically formed rubber elements, which are held by suction heads.

3. An apparatus according to claim 2, wherein the suction heads are held by a pipe, said pipe connecting also the suction bells to a vacuum source.

4. An apparatus according to claim 3, wherein the suction heads are provided with a recess which permits the feed pipe to be received between the suction bells.

5. An apparatus according to claim 3, wherein the sealing means are provided with an opening through which the pipe of the suction heads is guided.

6. An apparatus according to claim 1, wherein the sealing means are provided with a sealing edge, which is arranged above the suction means.

7. An apparatus according to claim 6, wherein the sealing means and the sealing edge consist of a metal, preferably of aluminum or brass.

8. An apparatus according to claim 6 wherein the sealing edge is provided with a sealing cover consisting of an elastic material.

9. An apparatus according to claim 1 wherein a sensor means is provided, which determines whether a sheet bag has correctly been received in the apparatus.

10. An apparatus according to claim 9, further comprising two sealing strips each provided with a contact spring, said contact spring abutting on the sheet bag, if such a sheet bag has correctly been received in the apparatus, whereas, if no such sheet bag has been received in the apparatus, the contact spring will abut on the metallic feed pipe.

11. An apparatus according to claim 9, wherein each suction means is connected to a vacuum switch supplying a signal if the vacuum produced in the suction bells is not sufficient.

12. An apparatus as in claim 1, wherein the bag has a filling spout, the suction bells being arranged for gripping opposite sides of the filling spout so as to cause the filling spout to open in response to relative movement of the suction bells.

13. A method for opening and filling a folded sheet bag, comprising the steps of:

opening the bag with two vacuum-type opening means which include suction bells, the step of opening including gripping the bag under vacuum with the suction bells and then moving the suction bells away from each other;

inserting a feed pipe into the bag for enabling the bag to be filled with fluid via the feed pipe;

sealing the bag with respect to the inserted feed pipe by two sealing means as the sealing means abut the feed pipe, the step of opening including moving the suction bells relative to the sealing means; and receiving the opening means in a recess of the sealing means as the sealing means abut on the feed pipe.

14. A method as in claim 13, wherein the bag has a filling spout, the step of opening including opening the filling spout in response to relative movement of the suction bells by gripping opposite sides of the filling spout with the suction bells.

15. An apparatus for opening and filling a folded sheet bag, comprising:

means for opening the bag;

a feed pipe insertable into the bag when the bag is open, the feed pipe enabling the bag to be filled with fluid;

means for sealing the bag with respect to the inserted feed pipe as said sealing means abuts the feed pipe, said opening means including elements which impart a vacuum and are movable relative to said sealing means, said elements being movable from a position for gripping under vacuum the bag in a closed condition to another position at which the elements move away from each other while still gripping the bag and thereby cause the bag to open; and means for receiving the opening means as the sealing means abuts on the feed pipe, said receiving means including a recess in said sealing means into which is received said opening means.

* * * * *